United States Patent [19]

Hamm et al.

[11] Patent Number: 4,879,441

[45] Date of Patent: Nov. 7, 1989

[54] DIELECTRIC BARRIER FOR A VACUUM INTERRUPTER

[75] Inventors: Sidney R. Hamm, Muskego; Ronald A. Wainio, South Milwaukee, both of Wis.

[73] Assignee: Cooper Industries, Inc.

[21] Appl. No.: 228,338

[22] Filed: Aug. 4, 1988

[51] Int. Cl.[4] ..... H01H 33/66

[52] U.S. Cl. ..... 200/144 B; 174/5 R

[58] Field of Search ..... 200/144 B; 174/5

[56] References Cited

U.S. PATENT DOCUMENTS

| | | | |
|---|---|---|---|
| 3,260,967 | 7/1966 | McClaflin et al. | 333/7 |
| 3,555,223 | 1/1971 | Robinson et al. | 200/144 B |
| 3,571,543 | 3/1971 | Perkins | 200/144 B |
| 3,702,931 | 11/1972 | Jacobsen | 174/52 R |
| 3,778,682 | 12/1973 | Bright | 174/5 R |
| 4,449,021 | 5/1984 | Wakayama et al. | 200/144 B |

*Primary Examiner*—Robert S. Macon

*Attorney, Agent, or Firm*—Haight & Hofeldt

[57] ABSTRACT

A dielectric barrier system for a vacuum switch is disclosed comprising: a dielectric barrier having three generally flat elongated rectangular walls, and means for holding the barrier at a spaced distance apart from the vacuum switch and from a high voltage conductor which is disposed at a spaced distance from the sides of the switch and along a path which includes a position which is generally adjacent to the opposite end to which the conductor is connected to the vacuum switch.

20 Claims, 3 Drawing Sheets

FIG. 3
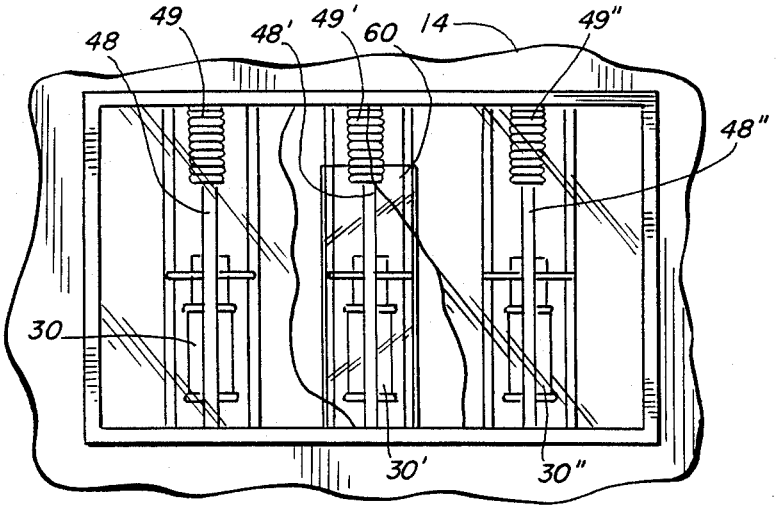
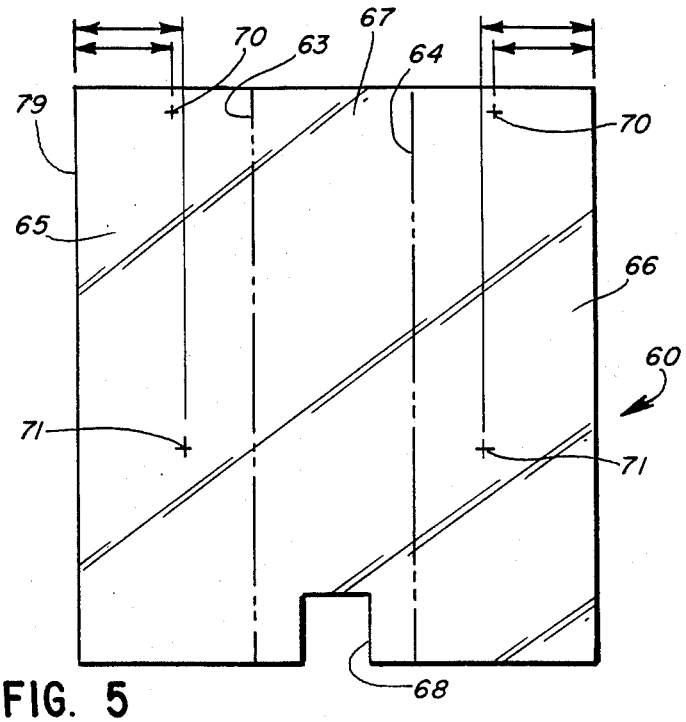
FIG. 5
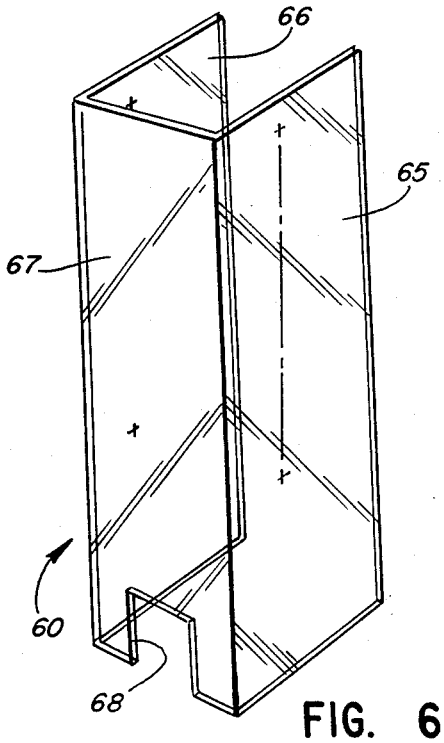
FIG. 6
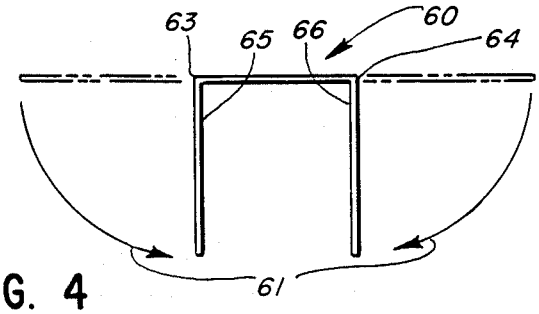
FIG. 4
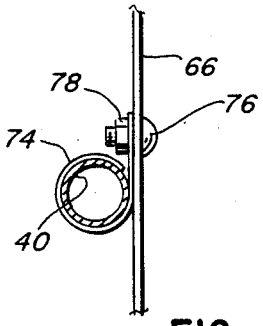
FIG. 7

DIELECTRIC BARRIER FOR A VACUUM INTERRUPTER

TECHNICAL FIELD

This invention relates, in general, to the subject matter of circuit breakers and, in particular, to high voltage vacuum interrupters.

BACKGROUND OF THE INVENTION

Vacuum interrupters provide fast, low energy arc interruption with long contact life, low maintenance, low mechanical stress, and maximum operating safety. Modern vacuum interrupters, such as produced by the assignee of the present invention, employ vacuum switches having a metal and ceramic housing for maximum strength. A high alumina ceramic housing has more than five times the strength of glass. The metal end-closures and arcing chambers are of high purity alloy to minimize contamination. The vacuum switches are housed together in a tank-like enclosure along with high voltage components.

As a voltage potential is applied between two components, a level is reached at which the insulating medium (e.g., air, oil, $SF_6$, etc.) cannot withstand the voltage stress and it flashes or arcs over. The withstand voltage level can be increased by spreading the components apart so that the voltage stress is reduced, or by using insulating medium with a higher voltage withstand level. The addition of insulation has the effect of increasing the voltage withstand level of the insulating medium. It does this because the barrier material has a higher withstand level than the surrounding insulating medium (e.g., air, oil, $SF_6$, etc.). It breaks up the paths where the flash-over would occur by increasing the live part string clearance.

Dielectric insulating barriers appear in two common forms:

1. Sheets of material that are located between high potential part and ground, or between the adjacent phase parts. These are referred to as "phase barriers"; and
2. Sheets that are attached to the interrupter tank or housing wall. These are referred to as tank or housing liners.

Electrical breakdown is significantly promoted by temperature which is often high enough to change the physical structure of the dielectric. Such a high temperature may be caused by heat from an external source; however, localized heat generated by the passage of current through the dielectric itself can be a cause of breakdown.

The weak point in insulation systems often occurs at the interface between materials of different permittivities. This explains why an electric arc always runs over the surface of an insulator suspended in air, rather than penetrating the insulator or traveling a much shorter distance through the air. This weak point is alleviated if the difference between the two permittivities is small. Thus, a solid insulator immersed in oil experiences a lower surface stress than one immersed in air; however, oil has its disadvantages.

The technology of testing and maintaining solid dielectrics is further complicated by the long-term effects of partial discharge or corona. As voltages are pushed higher, extruded plastic dielectrics have been developed to take the place of oil impregnated paper. Nevertheless, partial discharge and subsequent treeing have added a new dimension to dielectric problems. On problem is that it is very difficult to manufacture a solid dielectric that is totally uniform. Corona is most likely to occur at a sharp point or irregularity on a high voltage conductor, because the voltage stress is greater at points where the conductor surface is sharply curved. Thus, the design of high voltage vacuum interrupters is by no means simple. When components are housed close together and when potentials are increased to match new customer demands, arcing and flash-over can occur. Flash-over is further complicated because small changes in component geometry and material act together to defy simple solution.

SUMMARY OF THE INVENTION

In accordance with the present invention, a dielectric barrier system for a vacuum switch is disclosed. The vacuum switch is one of the type having two opposite ends with lower end connected to an elongated high voltage conductor which thereafter is disposed at a spaced distance from the sides of the switch and along a path which includes a position which is generally adjacent to the upper end of the switch. In particular, the dielectric barrier comprises three generally flat elongated rectangular walls, including a back wall and two side walls. The back wall is smoothly connected to each side wall and is located between the elongated high voltage conductor and the vacuum switch. The walls have upper ends which extend beyond the upper ends of the vacuum switch and have lower ends which are generally adjacent the lower end of the vacuum switch. Preferably, the walls are formed from a non-porous material which generally retains its flexibility and temperature down to at least 40 degrees below zero. Preferably, the barrier material is transparent and has an open side to allow visual inspection of the movable parts of the switch. The dielectric barrier is supported by a holding means which holds the barrier at a spaced distance apart from the vacuum switch and the elongated high voltage conductor, such that the barrier generally encompasses at least three sides of the switch and the back wall is located between the elongated high voltage conductor and the vacuum switch.

Some of the advantages of the disclosed barrier system are:

1. It prevents dielectric voltage flash-over by increasing the insulating medium voltage withstand level.
2. It facilitates interchangeability of new and existing vacuum switches in the same circuit interrupter.
3. It provides a smaller and lower weight circuit interrupter because of the smaller dielectric clearances required.
4. It provides for a more reliable circuit interrupter having more consistent voltage withstand levels.
5. It is smaller in size and less costly than phase barriers or tank liners.
6. It provides for more insulating coverage to include the leads, bushings and other live parts, instead of merely phase-to-phase or phase-to-ground protection.
7. It results in a generally less costly circuit interrupter.
8. It provides for efficient heat transfer to cool the vacuum interrupter assembly, inasmuch as it is not applied on the body of the associated high voltage conductor or the body of the high voltage vacuum switch.

Numerous other advantages and features of the present invention will become readily apparent from the following detailed description of the invention, the embodiments described therein, from the claims, and from the accompanying drawings.

BRIEF DESCRIPTION OF THE DRAWINGS

FIG. 3 is a simplified back view of the interrupter of FIG. 1, with the dielectric barrier attached to only the center vacuum switch;

FIG. 4 is a top view of the dielectric barrier of FIG. 2, as viewed along line 4—4, with the dielectric barrier removed from the associated vacuum switch;

FIG. 5 is a plan view of the dielectric barrier of FIG. 4, prior to being bent into shape;

FIG. 6 is a perspective view of the dielectric barrier of FIG. 5 after being bent into shape; and FIG. 7 is a partial top view of one means used to hold the dielectric barrier in place, as viewed along line 7—7 of FIG. 2.

DETAILED DESCRIPTION OF THE PREFERRED EMBODIMENT

Figure 1:
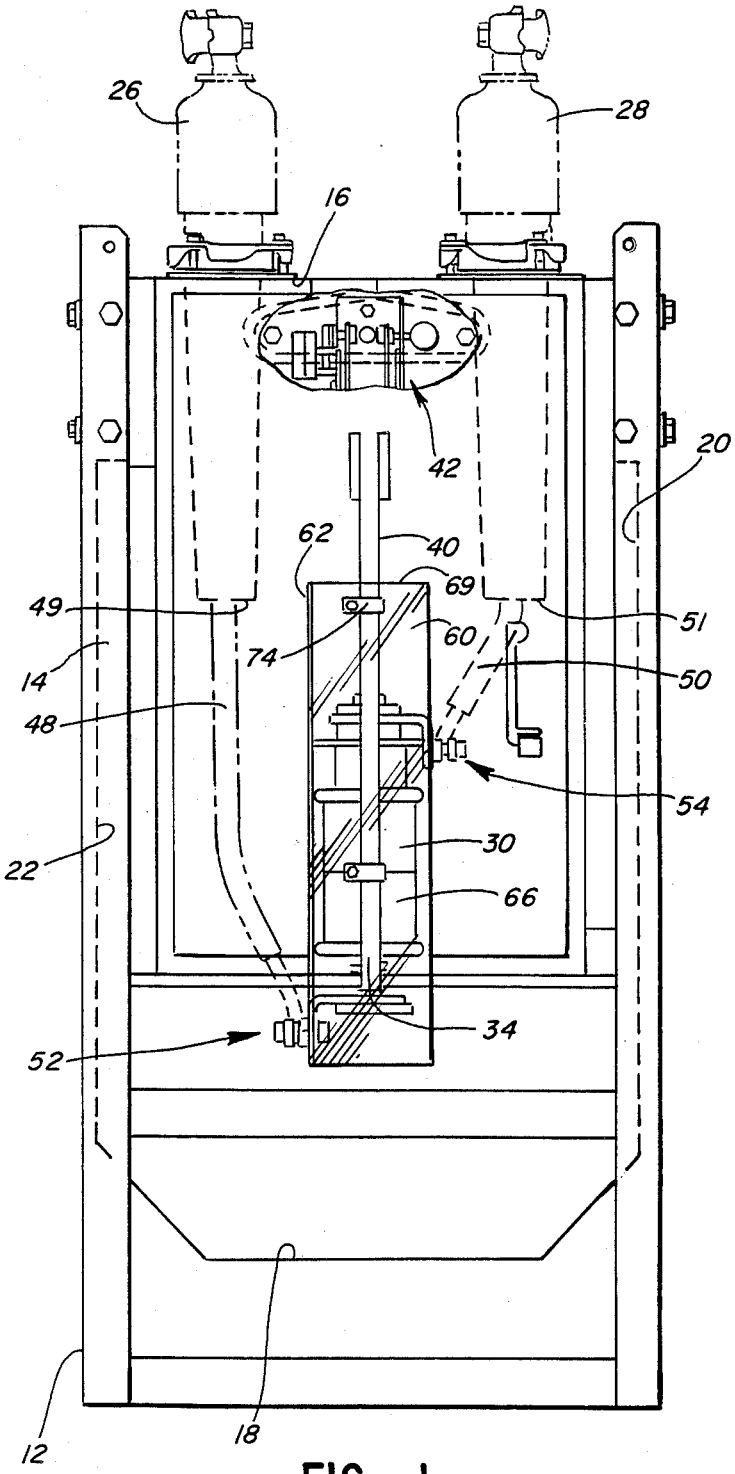
FIG. 1 is a partial side elevational view of a vacuum interrupter incorporating the dielectric barrier that is the subject of the present invention.

While this invention is susceptible of embodiment in many different forms, there is shown in the drawings and will herein be described in detail several specific embodiments of the invention. It should be understood, however, that the present disclosure is to be considered as an exemplification of the principles of the invention and is not intended to limit the invention to the specific embodiments illustrated.

Figure 2:
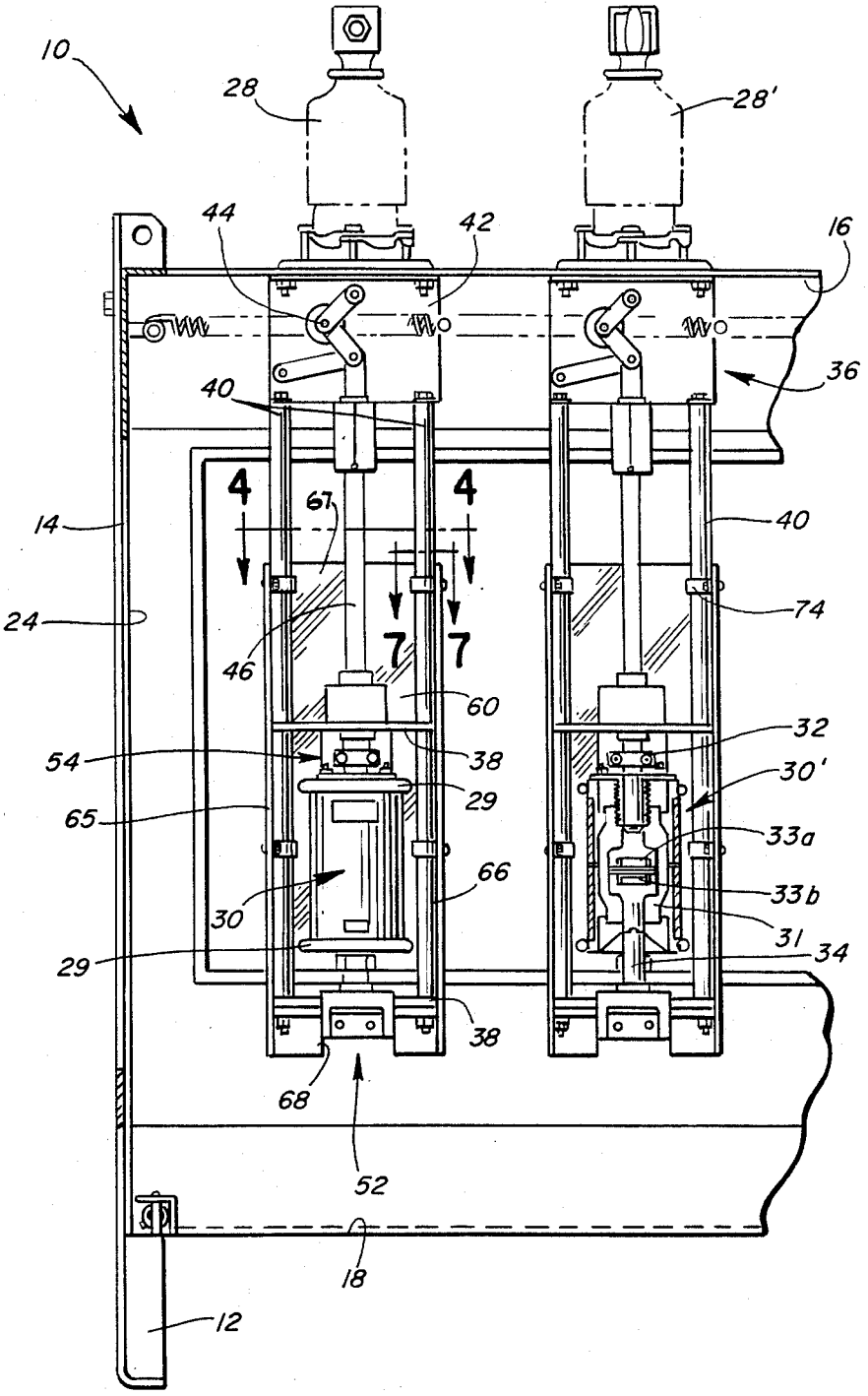
FIG. 2 is a partial front elevation view of the vacuum interrupter illustrated in FIG. 1.

Turning to FIG. 1, there is illustrated a vacuum interrupter 10 characterized by a supporting frame 12, a tank like enclosure 14 having a top wall 16, a bottom wall 18, a front wall 20, a back or rear wall 22, and two side walls 24 (see FIG. 2). In this particular embodiment, the enclosure 14 is filled with air under atmospheric pressure, so as to provide a weather proof housing suitable for outdoor use.

The top wall 16 supports a plurality of high voltage insulating bushings 26 and 28 for each vacuum switch. Contained within the enclosure 14 is a plurality of vacuum switches 30 and 30' which are arranged generally parallel to each other and spaced apart from each other and the walls 16, 18, 20, 22, and 24 of the enclosure 14. In this particular embodiment, the vacuum switches 30 and 30' are arranged generally vertically so as to have an upper end 32 and a lower end 34. Each switch has an elongated evacuated insulated envelope 31 (see FIG. 2, the right-hand side) which contains a pair of cooperating oppositely disposed electrical contacts **33*a* and 33*b*. Their axes of movement defines a longitudinal axis of the switch 30' (i.e., here vertical movement). One of the contacts, here the upper most one 33*a*, is moved relative to the other contact by means of an operating mechanism 36**.

The vacuum switches 30 and 30' are supported at each end by insulated support plates 38 which are in turn supported by pairs of oppositely disposed generally vertical stringers 40. The stringers 40 are attached to or carried by the top wall 16 by means of a bracket and link assembly 42. The links 44 of the bracket and link assembly 42 are joined to the upper end 32 (i.e., the moving end) of the vacuum switch 30 by means of a connecting rod 46.

Returning to FIG. 1, the bushings 26 and 28 for each switch carry therein a relatively thick copper conductor 48 and 50. For an interrupter rated at 15,500 volts and 800 amps (continuous), the high voltage conductors 48 and 50 have a diameter of approximately one inch. It has been found that it is not practical or advisable to heavily insulate that part of the conductors 48 and 50 which stem from the lower ends 49 and 51 of the bushings 26 and 28, since such added insulation will increase the build-up of heat within the enclosure 14. The conductors 48 and 50 pass out of lower ends 49 and 51 of their bushing. To prevent flash-over between the high voltage conductors and the top wall 16 of the enclosure 14, the lower ends 49 and 51 of the bushings 26 and 28 extend substantially downwardly into the interior of the tank. The conductors 48 and 50 are connected to the ends of their vacuum switch 30 by means of a current exchange means 52 and 54.

It is standard practice during the construction of such interrupters to conduct an impulse voltage test. During this test, a voltage of 110 kilovolts (i.e., $7\frac{1}{3}$ times the normal voltage rating) is applied to the interrupter 10. During the test, flash-over can occur between two switches 30 and 30' or between a switch and the walls of the enclosure 14. In designing a vacuum interrupter, it is advisable to make the interior of the container as smooth as possible and to avoid sharp corners or points which would attract an arc. Such sharp points attract or facilitate the function of an arc.

Due to the close proximity of the longer high voltage conductor 48, which is connected to the current exchange means 52 at the lower end 34 of the vacuum interrupter 30, it is believed that this conductor sufficiently changes the voltage stress distribution at the interior of the enclosure 14 that the possibility or likelihood of flash-over increases (e.g., flash-over from the upper end 32 of the vacuum switch). To reduce this potential for flash-over, a dielectric barrier 60 is installed. It may not to be practical to apply insulation directly to the vacuum switches 30 and 30' or the high voltage conductors 48 and 50, inasmuch as added insulation will increase the temperature of the switches or the conductors, which lowers the dielectric strength of the surrounding air. It also makes periodic visual inspection more difficult. Such inspections are required to determine vacuum interrupter contact erosion.

Turning now to FIGS. 4 and 5, the dielectric barrier 60 is formed from a generally flat rectangular sheet of polycarbonate (such as LEXON plastic, having a thickness of 0.06 inches). The barrier 60 is erected (see arrows 61 in FIG. 4) by bending the flat sheet 62 along two bend lines 63 and 64, so as to form two side walls 65 and 66 and one back wall 67. The back wall 67 has a rectangular cut-out 68 to fit around the lower current exchange means 52 (see FIGS. 1 and 2). In one particular embodiment, the barrier 60 has a height of 24 inches, side walls approximately 7.94 inches wide and a back wall of 7.13 inches in width. The side walls 65 and 66 each contain two apertures 70 and 71 for connecting the barrier 60 to the stringers 40. The barrier 60 is preferably made from a flat smooth material that retains its flexibility down to temperatures as cold as 40 degrees below zero. Preferably, the walls are non-porous and the material in which the barrier is formed is generally transparent. The transparency of the barrier allows the vacuum switches to be easily visually inspected without requiring disassembly (see FIG. 3). Other suitable materials for the barrier include: polypropylene, and track resistant polyester fiberglass.

Turning now to FIG. 7, one example of the manner in which the barrier 60 can be attached to the stringers 40 is illustrated. Specifically, nylon cable clips 74 are wrapped around the stringers 40 and a non-metallic bolt (e.g., nylon) 76 and nut 78 are used to hold the cable clip and the barrier 60 together. In one embodiment, the stringers 40 are constructed from a filament of spiral wound glass as a base and from an epoxy resin as an impregnate or saturate.

The barrier 60 has a length which is substantially greater than the overall length of its associated vacuum switch. When installed in place, the back wall 67 (see FIG. 1) is located between its vacuum switch 30 and the high voltage conductor 48 which is connected to the lower end 34 of the vacuum switch. The side walls 65 and 66 ar located adjacent one another (see FIG. 2) and the side walls 24 of the enclosure 14. Preferably, the upper most end 69 of the barrier 60 extends slightly beyond (see FIG. 1) the lower end 49 of the bushings 26 and 28.

The barrier 60 does not provide any mechanical function. Its purpose is to prevent voltage from flashing over between parts by providing a restricting barrier directly between high voltage components with a "strike and creep" length or distance to prevent flash-over around the barrier ends. The normal voltage breakdown path would be at the shortest straight line dimension between the parts. The barrier 60 will not allow puncturing of the voltage arc through the barrier material at the shortest path and it provides a path long enough around the ends of the barrier to prevent the arc from flashing around the ends from one part to another. This should not be confused with an arrangement wherein box-like insulation is applied to the exterior of the vacuum switch (c.f., U.S. Pat. No. 3,571,543) for the primary purpose of providing mechanical support to the associated vacuum switches and wherein the high voltage conductors are separated from the lateral sides of the vacuum switches (i.e., oppositely disposed bushings are used).

The important point is that the barrier 60 has a strike and a creep length distance sufficiently large to prevent flash-over around its upper and lower ends. This is one reason why the lower end 61 of the barrier 60 is notched or so as to provide cutout 68.

Figure 1A:
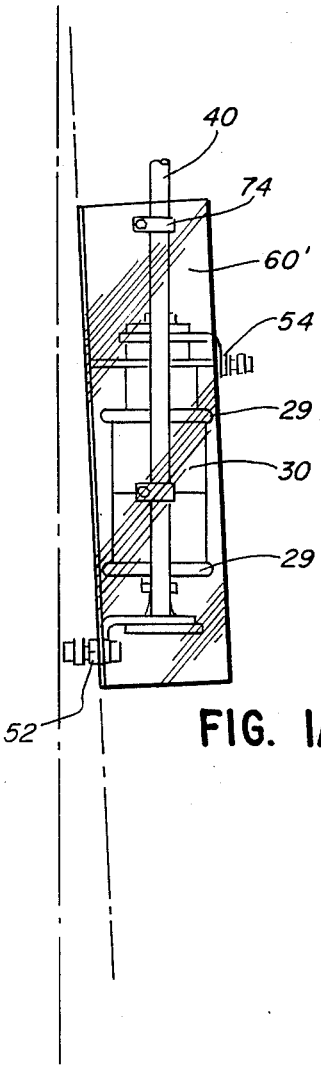
FIG. 1A is an exaggerated partial side elevational view of one embodiment of the dielectric barrier showing the manner in which it is oriented relative to its vacuum switch.

Because some vacuum switches may have rings 29 (i.e., grading rings) which extend or have a greater diameter than the insulated body of the vacuum switch, and because space may be limited at the inside of the enclosure 14, it has been found that, in some situations, it may be necessary to tilt the barrier 60, such that the back wall 67 is inclined at an angle while the side walls 65 and 66 remain substantially vertical (see FIG. 1A). This is accomplished by forming the mounting apertures 70 and 71 in the side walls 65 and 66, such that the upper apertures 70 are located further from the back wall 67 of the barrier 60. In the case of the 24 inch long barrier previously described, the upper aperture was located 4.38 inches from the front edge 79 and the lower aperture 71 was located 4.81 inches.

From the foregoing, it will be seen that barrier 60 acts to: increase the insulating medium voltage withstand level; facilitate interchangeability of new with existing vacuum switches in the same circuit interrupter without requiring a complete redesign of the enclosure 14 and the internal arrangements; provide a smaller and lower weight circuit interrupter without reducing dielectric clearance requirements; provide for a more reliable circuit interrupter with more consistent voltage withstand levels; keep the overall size small and thereby reduce the manufacturing cost; provide insulation coverage which includes the bushing high voltage conductors and other live parts a opposed to simple phase-to-phase or phase-to-ground insulation; and improve the dielectric strength without increasing temperature build-up in the high voltage conductor or the vacuum switch.

From the foregoing description, it will be observed that numerous variations and modifications may be affected without departing from the true spirit and scope of the novel concept of the invention. For example, the shape of the dielectric barrier need not be rectangular; a tube or semicylindrical shape may be more appropriate, considering the geometry of the interior of the interrupter. It is, of course, intended to cover by the appended claims all such modifications as fall within the scope of the claims.

We claim:

1. With a high voltage interrupter of the type characterized by a container having at least one peripheral wall and an end wall, having therein a plurality of generally parallel vacuum switches which are spaced apart from each other and the walls of the container, having a mechanism which is carried by the end wall and which operates each vacuum switch, and having current exchange means for supplying electrical current from the end wall to the ends of each vacuum switch, each vacuum switch having a pair of cooperating oppositely disposed electrical contacts, one of the contacts being moved relative to the other contact by the mechanism and the other contact being electrically connected to the current exchange means by a conductor which disposed between the peripheral wall and the vacuum switch, apparatus comprising:

(a) stringer means, carried by the container, for carrying each vacuum switch at a spaced distance from the walls of the container, said stringer means comprising at least one elongated stringer which is arranged generally parallel to the longitudinal axis of the vacuum switch and at a spaced distance from the vacuum switch; and (b) an open dielectric barrier for at least one switch, said barrier being carried by said stringer at a spaced distance from the walls of the container and being spaced apart from and generally around said one vacuum switch, said barrier having a longitudinal dimension which is substantially greater than the longitudinal dimension of said one switch, having one generally flat smooth side which is disposed between said one switch and the other switch, having another generally flat smooth side which is disposed between said one switch and the current exchange conductor for said one switch, and having an open side for visual inspection of said one switch.

2. The apparatus of claim 1, wherein said dielectric barrier further includes a third side which is generally the same as said one side and which is connected to said another side, such that a three-sided generally rectangular barrier is formed around said one switch.

3. The apparatus of claim 2, wherein said current exchange means includes a second conductor which is connected to said one contact; and wherein said barrier has an open side for said second conductor to pass therethrough, said open side being located opposite to said another side.

4. With a high voltage interrupter of the type characterized by: a tank-like container having an upper end and a lower end, at least two vacuum switches in the container which are arranged generally parallel to each other and which are spaced apart from each other and the container, a mechanism which is carried by the container and which operates the vacuum switches, and supply means for supplying current from the upper end of the container to the lower end of each switch, each switch having a generally elongated evacuated envelope containing a pair of cooperating oppositely disposed electrical contacts which extend out of the envelope and which define the longitudinal axis of the switch, the contacts being moved longitudinally relative to the other contact by the mechanism, the switches being in such close proximity to each other and the container and the current supply means that for its rated voltage flash-over can occur from at least one switch to the other switch or to the container due at least in part to the non-symmetrical voltage stress distribution from the supply means, a dielectric barrier system:

(a) support means, carried by the container for supporting a vacuum switch;

(b) an elongated, generally smooth, flat, three-sided dielectric barrier which disposed about each switch and between the upper end of the container and the distal end of its switch and which is interposed between its switch and the current supply means for that switch; and (c) holding means, carried by said support means, for holding each barrier at a spaced distance apart from its switch and the container.

5. The barrier system of claims 4, wherein said support means comprises: at least two elongated insulated stringers which are carried by the container and which are arranged generally parallel to the longitudinal axis of the switch and at a spaced distance from each side of the switch.

6. The barrier system of claim 5, wherein said stringers are disposed between the switch and said barrier using non-metallic threaded fasteners.

7. The barrier system of claim 4 wherein the distal end of said vacuum switch is supported by said support means.

8. The barrier system of claim 4, wherein the contacts of the switch are located at the lower half of said dielectric barrier.

9. The barrier system of claim 4, wherein said barrier has a strike and creep length distance to prevent flash-over around its upper and lower ends.

10. The barrier system of claim 4, wherein said barrier comprises three generally rectangular non-porous walls.

11. The barrier system of claim 4, wherein said barrier is formed from a generally transparent material which does not substantially loose its flexibility due to cold temperatures down to as low as minus 40 degrees Fahrenheit.

12. An interrupter, comprising:

(a) a container having at least one side wall which is attached to a top wall;

(b) at least two vertically disposed vacuum switches which are carried by said top wall, which are spaced apart from each other and said walls of said container, and which are generally located at the lower end of said container, each vacuum switch having a generally elongated evacuated envelope which contains a pair of cooperating oppositely disposed electrical contacts which extend out of said envelope at its upper end and its lower end;

(c) supply means carried by said top wall for supplying high voltage to said vacuum switches, said supply means including a high voltage bushing for each switch which is carried by said top wall and which has an extended lower end and which contains a conductor which is disposed between said side wall and its vacuum switch and which is adapted to pass current from the exterior of said container to the electrical contact at said lower end of its vacuum switch;

(d) at least one elongated vertical stringer which is carried by said top wall at a spaced distance from said vacuum switches and at a distance from said side wall; and e) an elongated dielectric barrier which is carried by said one stringer between one switch and its conductor, which generally encompasses said one switch at a spaced distance from said one switch, which has an upper end which extends beyond said lower end of the high voltage bushing from said one switch, and which has a lower end which is adjacent said lower end of said one switch.

13. The interrupter of claim 12, wherein said barrier has three generally flat rectangular walls including a back wall and two side walls, said back wall being integrally connected to each side wall and being located between said one vacuum switch and its conductor.

14. The interrupter of claim 13, wherein said two side walls are carried substantially vertically and said back wall is carried generally vertically.

15. A vacuum interrupter, comprising:

(a) a base;

(b) at least two vacuum switches which are carried by said base and which ar arranged generally spaced apart and along side each other, each switch having a generally elongated evacuated envelope containing a pair of cooperating oppositely disposed electrical contacts which extend out of the envelope and which define the longitudinal axis of the switch, one of the contacts being adapted to be moved longitudinally relative to the other contact;

(c) at least one elongated insulated stringer for supporting one switch at a spaced distance from said base, said stringer being carried by said base and being arranged generally parallel to the longitudinal axis of said one switch and at a spaced distance from the sides of said one switch;

(d) at least one high voltage electrical bushing which are carried by said base, said bushing being arranged generally parallel to and spaced apart from said one switch, each bushing carrying a conductor therein for supplying electrical current to the distal end of said one switch, said conductors lying generally spaced apart from the sides of said one switch;

(e) a three-sided dielectric barrier which are located between said one switch and said conductor; and (f) holding means, carried by said stringers, for holding each barrier at a spaced distance apart from said one switch and said conductor.

16. A dielectric barrier system for a vacuum switch having two opposite ends and having one end connected to a high voltage conductor which thereafter is disposed at a spaced distance from the sides of the switch and along a path which includes a position which is generally adjacent to the opposite end of the switch, comprising:

(a) a dielectric barrier having three generally flat, elongated, rectangular walls including a back wall and two side walls, said back wall being smoothly connected to each side wall and being located generally between the conductor and the vacuum switch, said walls having an upper end which extends substantially beyond the opposite end of the vacuum switch and having a owner end which is generally adjacent the one end of the vacuum switch, said walls being formed from a non-porous material which generally retains its flexibility at temperatures below zero and which is generally transparent; and (b) holding means for holding said barrier at a spaced distance apart from the vacuum switch and the conductor, such that said barrier generally encompasses at least three sides of the vacuum switch and said back wall is between the conductor and the vacuum switch, and for holding said barrier so that at most the one end of the vacuum switch is in physical contact with said back wall.

17. The barrier system of claim 16, wherein said high voltage conductor is carried from one end of a bushing, said one end of said bushing being generally located adjacent said upper end of said barrier.

18. The barrier system of claim 16, wherein said path of said conductor is generally parallel to the axis of movement of the contacts of the switch.

19. The barrier system of claims 18, wherein said barrier is held with said side walls disposed substantially parallel to said axis and said back wall disposed generally parallel to said axis.

20. The barrier system of claim 16, wherein said flexibility is retained to about 40 degrees below zero.

* * * * *